US005395121A

United States Patent [19]

Sullivan

[11] Patent Number: 5,395,121

[45] Date of Patent: Mar. 7, 1995

[54] BUBBLE SKILL GAME

[76] Inventor: Michael J. Sullivan, 554 Ashland Ave., River Forest, Ill. 60305-1825

[21] Appl. No.: 207,566

[22] Filed: Mar. 7, 1994

[51] Int. Cl.[6] ..... A63B 67/00; A63H 33/28

[52] U.S. Cl. ..... 273/348; 273/317; 446/15

[58] Field of Search ..... 446/15, 16, 17, 18, 446/19, 20, 21; 273/348, 402

[56] References Cited

U.S. PATENT DOCUMENTS

| | | | |
|---|---|---|---|
| 519,770 | 5/1894 | McNaughton | 273/402 X |
| 529,043 | 11/1894 | McNaughton | 273/402 X |
| 2,382,949 | 8/1945 | McLaren | 446/15 |
| 3,950,887 | 4/1976 | Kort | 446/15 |

*Primary Examiner*—William H. Grieb

[57] ABSTRACT

A bubble skill game which is comprised of
- a handle including an orifice 25
- a target
- a reservoir for holding bubble forming liquid connected to a base 3.

The game is played by holding the handle and dipping the orifice 25 into the reservoir of bubble liquid 40 forming a membrane of bubble liquid over the orifice 25. The handle is then moved through the air in the direction of the target producing numerous bubbles travelling in the direction of the target. The object is to have one or more bubbles go into the target.

The handle and target can be constructed to resemble various common games of skill (golf, hockey, croquet, tennis, baseball, etc.).

6 Claims, 3 Drawing Sheets

BUBBLE SKILL GAME

BACKGROUND OF THE INVENTION

1. Field of the Invention

This invention relates to a device for making bubbles.

2. Description of Prior Art

Various devices for making bubbles exist. They are usually simple in nature comprising an orifice with a handle, the orifice being designed to be dipped into bubble forming liquid which forms a membrane spanning the orifice. Blowing air across the orifice or moving the orifice through the air causes the membrane to stretch and form one or more bubbles. When a bubble exceeds the tensile strength of the membrane it breaks loose and becomes free floating. Some examples of prior art bubble making devices are bubble wands, bubble swords, and bubble daggers. Each of these devices involve dipping an orifice into bubble forming liquid which forms a membrane spanning the orifice. Blowing air across the orifice or moving the device through the air causes the membrane to stretch and form a bubble. When the bubble exceeds the tensile strength of the membrane it breaks loose into a free floating bubble. No target is designated for the bubbles and no game of skill is suggested or implied.

OBJECTS AND ADVANTAGES

The objects and advantages of the present invention are:

- to provide a novel bubble skill game that is simple to make, preeminently capable of making bubbles, and enjoyable for children.
- to provide a bubble skill game where the bubbles formed are aimed at a target.
- to provide a bubble skill game which has simple parts which may be easily assembled.
- to provide a bubble skill game for children that is easy to understand and operate.
- to provide a novel bubble skill game comprising
  - a handle including an orifice
  - a target
  - a reservoir for holding bubble forming liquid connected to a base.
- to provide a bubble skill game with many embodiments which mimic more difficult non bubble games of skill (golf, hockey, croquet, tennis, baseball, etc.)

DESCRIPTION—FIGS. 1 TO 11

Figure 4:
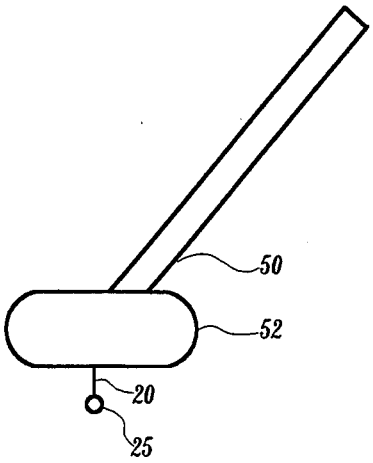
FIG. 4 Illustrates a hockey blade embodiment of the invention.
Figure 5:
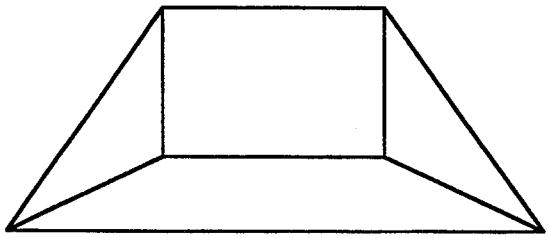

FIG. 5 Shows a target for use with FIG. 4 embodiment. For this embodiment the target is a freestanding four sided structure that is open at the bottom and the front. This represents a hockey net.

Figure 6:
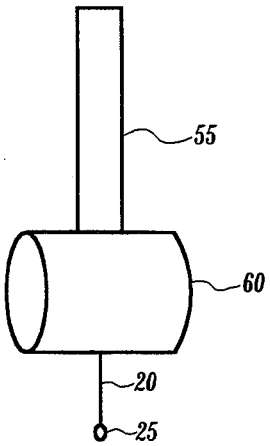

FIG. 6 Illustrates a side view of a croquet mallet embodiment of the invention.

Figure 6A:
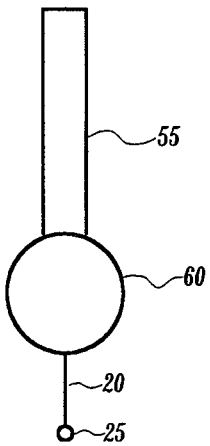

FIG. 6*a* Illustrates a front view of a croquet mallet embodiment of the invention shown in FIG. 6.

Figure 7:
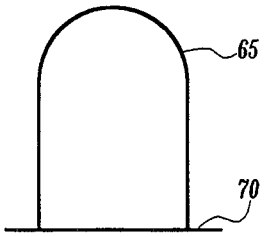

FIG. 7 Shows a target for use with FIG. 6 embodiment. It is a freestanding wicket with a base.

Figure 8:
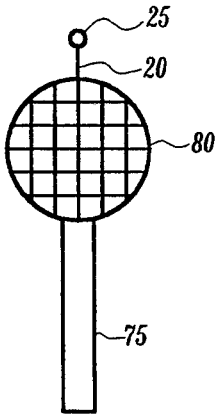

FIG. 8 Illustrates a tennis racket embodiment of the invention.

Figure 9:
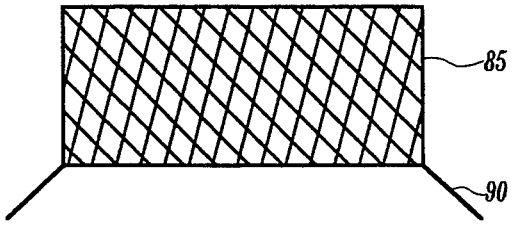

FIG. 9 Shows a target for use with FIG. 8 embodiment. For this embodiment the target is a freestanding net. The net stands perpendicular to the ground.

Figure 10:
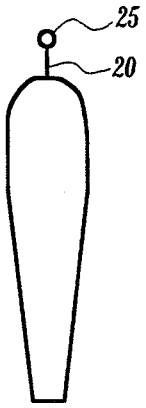

FIG. 10 Illustrates a baseball bat embodiment of the invention.

Figure 11:
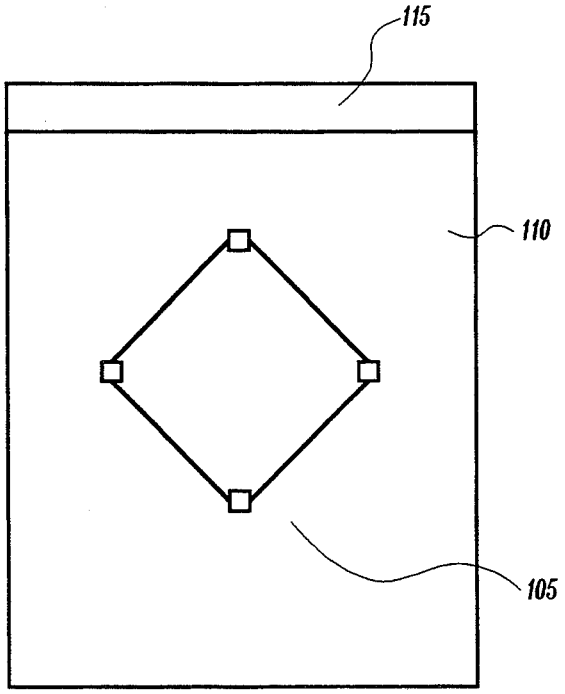

FIG. 11 Shows a target for use with FIG. 10 embodiment. For this embodiment the target is a mat that is marked off like a baseball field. The infield, the outfield and the bleachers are designated.

REFERENCE NUMERALS IN DRAWINGS

10 golf club handle
15 golf club head
20 stem
25 orifice
30 mat
35 target circle
40 reservoir
45 reservoir base
50 hockey stick handle
52 hockey stick blade
55 croquet mallet handle
60 croquet mallet head
65 target wicket
70 target wicket base
75 tennis racket handle
80 tennis racket head
85 target net
90 target net base
105 baseball field target infield
110 baseball field target outfield
115 baseball field target bleachers

OPERATION OF FIGS. 1–3

Figure 2:
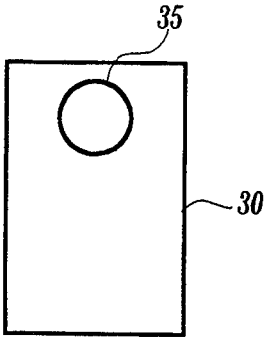
FIG. 2 Shows a target for use with FIG. 1 embodiment. For this embodiment the target is a mat that represents a golf green and a circle that represents a gold hole.
Figure 3:
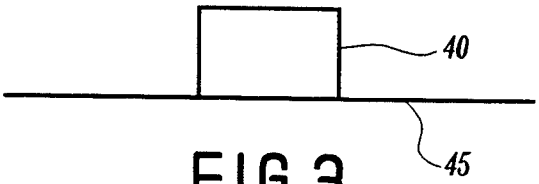
FIG. 3 Illustrates a side view of a reservoir for holding bubble forming liquid.
Figure 3A:
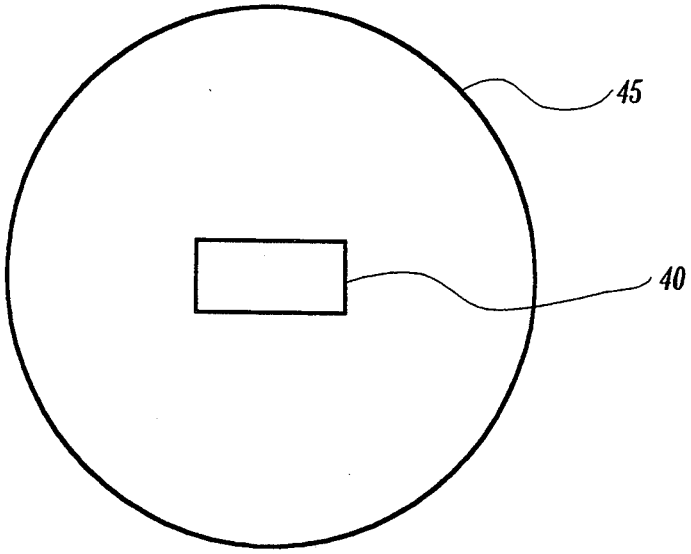
FIG. 3A Illustrates a top view of the reservoir of FIG. 3 for holding bubble forming liquid.

In this embodiment of the present invention the device is shown incorporated as a golf game. The bubble golf game consists of a golf club ending in a stem 20 with an orifice 25 attached FIG. 1, a mat 30 with a circle 35 representing a golf green with a golf hole designated as the target FIG. 2, and a reservoir 40 for holding bubble forming liquid FIG. 3 (side view). FIG. 3A shows a top view of the reservoir 40 and its base 45. The base 45 prevents tipping and contains spillage.

Figure 1:
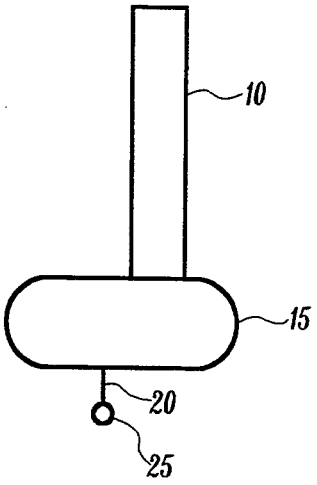
FIG. 1 Illustrates a gold club embodiment of the invention.

To play the game the child holds the golf club FIG. 1 and dips the orifice 25 completely into the reservoir of bubble forming liquid 40 forming a membrane over the orifice 25. The child then moves the club FIG. 1 through the air in the direction of the target circle 35. This produces a stream of bubbles that travels in the direction of the target circle 35. The object is to have at least one bubble land on the target circle 35. The bubbles will break upon contact with the target circle or game mat.

OPERATION OF FIGS. 4 AND 5

In this embodiment of the present invention the device is shown incorporated as a hockey game. The bubble hockey game consists of a hockey stick ending in a stem 20 with an orifice 25 attached FIG. 4, a freestanding four sided structure open at the bottom and the front designated as the target net FIG. 5, and a reservoir for holding bubble forming liquid FIG. 3.

To play the game the child holds the hockey stick FIG. 4 and dips the orifice 25 completely into the reservoir of bubble forming liquid 40 forming a membrane over the orifice 25. The child then moves the hockey stick FIG. 4 through the air in the direction of the target net FIG. 5. This produces a stream of bubbles travelling in the direction of the target net FIG. 5. The object is to have at least one bubble land in the target net FIG. 5. The bubbles will break upon contact with the target net or game mat.

OPERATION OF FIGS. 6 AND 7

In this embodiment of the present invention the device is shown incorporated as a croquet game. The bubble croquet game consists of a croquet mallet ending in a stem 20 with an orifice 25 attached FIG. 6, a freestanding wicket 65 with a base 70 designated as the target FIG. 7, and a reservoir for holding bubble forming liquid FIG. 3.

To play the game the child holds the croquet mallet FIG. 6 and dips the orifice 25 completely into the reservoir of bubble forming liquid 40 forming a membrane over the orifice 25. The child then moves the croquet mallet FIG. 6 through the air in the direction of the target wicket FIG. 7. This produces a stream of bubbles travelling in the direction of the target wicket FIG. 7. The object is to have at least one bubble go through the target wicket FIG. 7. The bubbles will break upon contact with the target wicket or game mat.

OPERATION OF FIGS. 8 AND 9

In this embodiment of the present invention the device is shown incorporated as a tennis game. The bubble tennis game consists of a tennis racket ending in a stem 20 with an orifice 25 attached FIG. 8, a freestanding net 85 with a base 90 designated as the target FIG. 9, and a reservoir for holding bubble forming liquid FIG. 3.

To play the game the child holds the tennis racket FIG. 8 and dips the orifice 25 completely into the reservoir of bubble forming liquid 40 forming a membrane over the orifice 25. The child then moves the tennis racket FIG. 8 through the air in the direction of the target net FIG. 9. This produces a stream of bubbles travelling in the direction of the target net FIG. 9. The object is to have at least one bubble go over the target net FIG. 9. The bubbles will break upon contact with the target net or game mat.

OPERATION OF FIGS. 10 AND 11

In this embodiment of the present invention the device is shown incorporated as a baseball game. The bubble baseball game consists of a baseball bat ending in a stem 20 with an orifice 25 attached FIG. 10, a mat marked off like a baseball field with an infield 105, an outfield 110 and the bleachers 115 designated as the target FIG. 11, and a reservoir for holding bubble forming liquid FIG. 3.

To play the game the child holds the baseball bat FIG. 10 and dips the orifice 25 completely into the reservoir of bubble forming liquid 40 forming a membrane over the orifice 25. The child then moves the baseball bat FIG. 10 through the air in the direction of the target mat FIG. 11. This produces a stream of bubbles travelling in the direction of the target mat FIG. 11. The object is to have at least one bubble go over the bleacher section 115 of the target mat FIG. 11. The bubbles will break upon contact with the target mat.

SUMMARY RAMIFICATIONS AND SCOPE

Thus the reader will see that the bubble skill game is easy for children to understand and operate, enjoyable to play with, and easy to make.

While my above description contains many specifications, these should not be construed as limitations on the scope of the invention but rather as exemplifications of some preferred embodiments thereof. May other variations are possible. For example

- a bubble skill game with a table tennis paddle and target net.
- a bubble skill game with a pinwheel and a target.
- a bubble skill game with a lacrosse stick and a target net.
- a bubble skill game with a racquetball racquet and a back wall target.

Other embodiments could include varying the size, shape, or quantity of the orifices. This would vary the size and quantity of the bubbles produced.

The handles and targets could be produced in a variety of sizes and colors.

Customized scorecards that correspond to a given sport embodiment could be packaged with the game.

Accordingly the scope of the invention should be determined not by the embodiments illustrated but by the appended claims and their legal equivalents.

I claim:

1. A bubble game comprising:

a) a broad based bubble reservoir for holding bubble forming liquid;

b) a target;

c) a handle including an orifice that when dipped into the reservoir of bubble liquid forms a membrane such that when the handle is moved through the air in the direction of the target the membrane breaks off into several free floating bubbles traveling in the general direction of the target, wherein said handle includes a striking surface in the form of a common sport striking surface and said orifice is positioned adjacent to said striking surface, and said target is in the form of a sport equipment used in the same sport as said striking surface.

2. The game of claim 1 where said striking surface is in the form of a golf club head and said target is in the form of a golf hole.

3. The game of claim 1 where said striking surface is in the form of a hockey stick blade and said target is in the form of a hockey net.

4. The game of claim 1 where said striking surface is in the form of a croquet mallet head and said target is in the form of a croquet wicket.

5. The game of claim 1 where said striking surface is in the form of a tennis racket head and said target is in the form of a tennis net.

6. The game of claim 1 where said striking surface is in the form of a baseball bat and said target is in the form of a baseball field.

* * * * *